US005723912A

United States Patent [19]

Ahrabian et al.

[11] Patent Number: 5,723,912

[45] Date of Patent: Mar. 3, 1998

[54] REMOTE KEYLESS ENTRY SYSTEM HAVING A HELICAL ANTENNA

[75] Inventors: Mahmood Ahrabian, Novi; William P. Sullivan, Lapeer, both of Mich.

[73] Assignee: TRW Inc., Lyndhurst, Ohio

[21] Appl. No.: 638,890

[22] Filed: Apr. 25, 1996

[51] Int. Cl.[6] ..... H01Q 11/08; H01Q 1/40

[52] U.S. Cl. ..... 307/10.5; 307/10.1; 307/9.1; 340/825.69; 340/825.72; 343/711; 343/759; 343/796

[58] Field of Search ..... 307/9.1–10.8; 343/711, 712, 713, 715, 900, 895, 759, 796; 340/825.69, 825.72; 180/287

[56] References Cited

U.S. PATENT DOCUMENTS

| | | | |
|---|---|---|---|
| 3,111,669 | 11/1963 | Walsh | 343/711 |
| 4,101,899 | 7/1978 | Jones, Jr. | 343/895 |
| 4,161,737 | 7/1979 | Albright | 343/895 |
| 4,742,359 | 5/1988 | Ishino | 343/895 |
| 4,760,394 | 7/1988 | Takeuchi | 340/825.69 |
| 4,764,773 | 8/1988 | Larsen | 343/713 |
| 4,811,024 | 3/1989 | Ohe | 343/712 |
| 4,881,148 | 11/1989 | Lambropoulos et al. | 340/825.69 |
| 4,973,958 | 11/1990 | Hirano et al. | 340/825.69 |
| 5,006,861 | 4/1991 | Miller | 343/895 |
| 5,278,573 | 1/1994 | Siikarla | 343/895 |
| 5,341,149 | 8/1994 | Valimaa | 343/895 |
| 5,442,341 | 8/1995 | Lambropoulos | 340/825.69 |
| 5,467,096 | 11/1995 | Takamoro | 343/895 |
| 5,499,022 | 3/1996 | Boschini | 340/825.69 |

*Primary Examiner*—William M. Shoop, Jr.
*Assistant Examiner*—Peter Ganjian
*Attorney, Agent, or Firm*—Tarolli, Sundheim, Covell, Tummino & Szabo

[57] ABSTRACT

A vehicle controller is presented for use in a remote keyless entry system for controlling a vehicle device function. The controller includes a receiver for receiving a RF request signal including a security code uniquely identifying a portable transmitter that is authorized entry into the vehicle and for controlling access to the vehicle when the received security code matches a prestored security code. A circuit board carries the receiver and a flat ground plane. A helical antenna is mounted on the circuit board and includes an elongated conductive member having one end electrically connected to the receiver means and an opposite free end. The conductive member is helically coiled about a helical axis intermediate the ends thereof with the helical axis being perpendicular to the ground plane. The antenna is configured to provide an omni-directional radiation pattern about the helical axis.

12 Claims, 3 Drawing Sheets

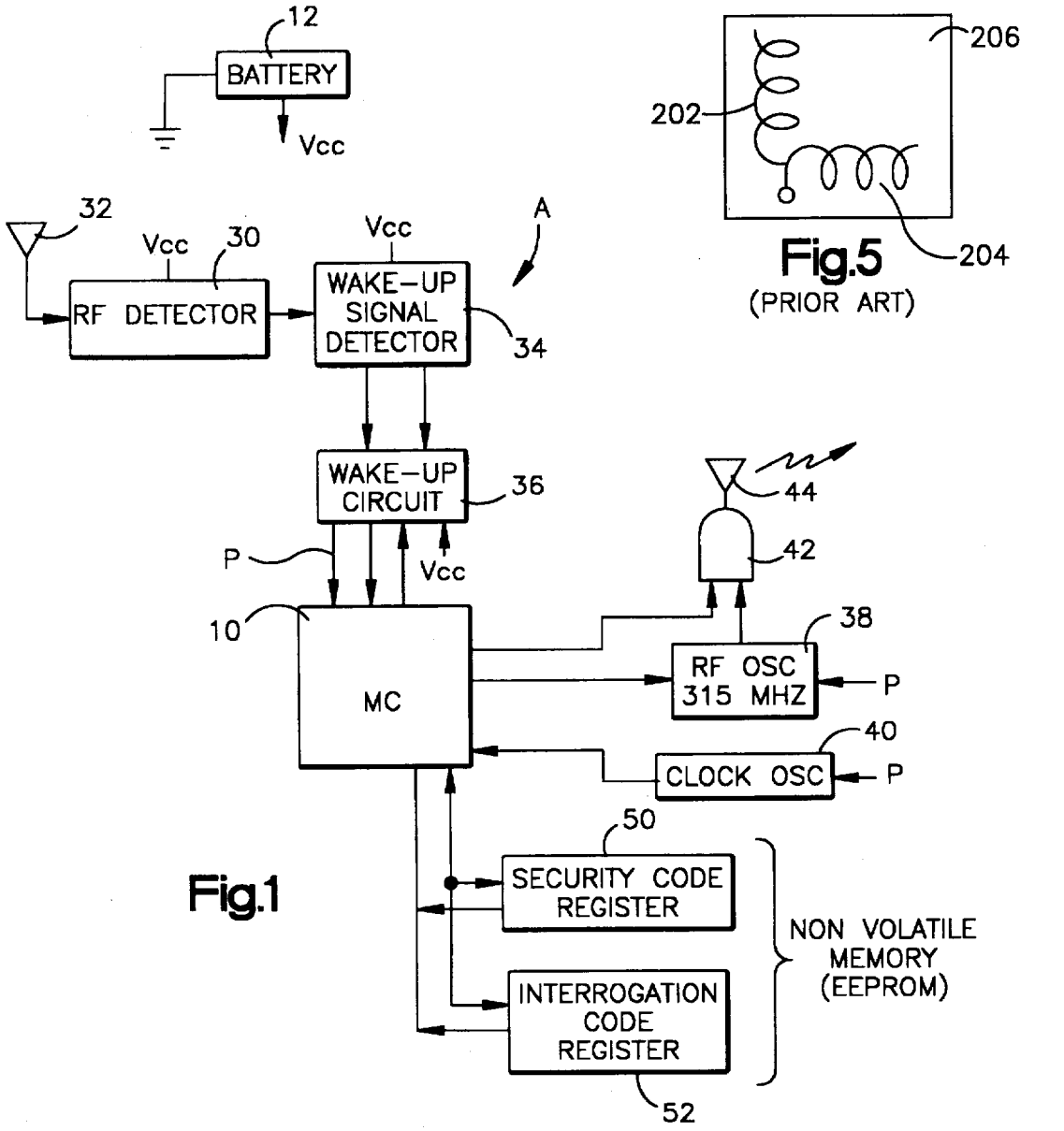
Fig.1
Fig.5
(PRIOR ART)
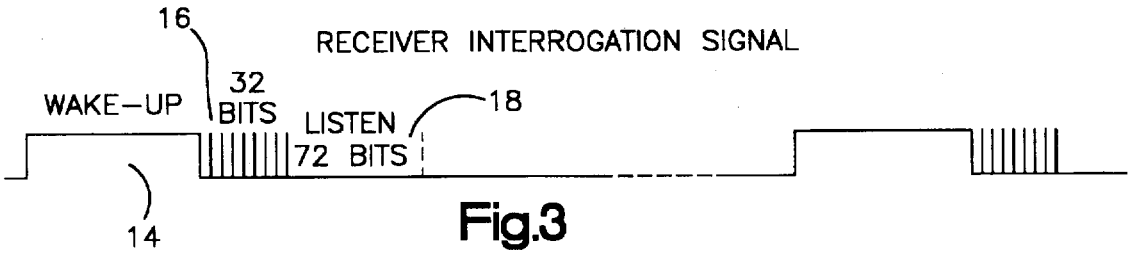
Fig.3
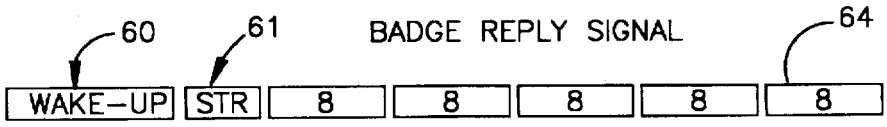
Fig.4

REMOTE KEYLESS ENTRY SYSTEM HAVING A HELICAL ANTENNA

FIELD OF THE INVENTION

The present invention relates to the art of remote keyless entry systems and, more particularly, to an improved system wherein a vehicle receiver or transceiver includes a helical antenna.

DESCRIPTION OF THE PRIOR ART

Remote keyless entry (RKE) systems are known in the art and include a receiver mounted in a motor vehicle and at least one portable hand held transmitter located remote from the receiver. Each transmitter is provided with a plurality of manually actuatable switches, each representative of a vehicle control function to be performed, such as the unlocking of the vehicle door. The transmitter responds to the actuation of one of the switches to transmit a digital signal having a security code which uniquely distinguishes the transmitter from a plurality of similar transmitters and a function code representative of the control function to be performed. When the receiver receives such a digital signal, it compares the received security code with a stored security code. If a match takes place, the receiver responds to the function code by causing performance of the control function requested, as by unlocking a vehicle door. A system, as described above, is disclosed in the U.S. Pat. No. to Lambropoulos, et al. 4,881,148, the disclosure of which is herein incorporated by reference.

A passive RKE system is one in which the operator need not actuate a switch on a remote transmitter in order to transmit a coded signal to a vehicle receiver in order to unlock a vehicle door or the like. One such system is disclosed in the U.S. Pat. No. to Hirano et al. 4,973,958. That system includes a vehicle mounted transceiver that periodically transmits an interrogating demand signal. A portable transceiver carried by an operator may receive the demand signal and respond by sending a reply signal back to the vehicle transceiver with the reply signal including a security code that uniquely identifies one portable transceiver. At the vehicle transceiver, the received security code is compared with a stored security code and, if a match takes place, the requested control function, such as unlock a vehicle door, is accomplished.

Whether the RKE system employed is an active system as described in the Lambropolos et al. patent or a passive system as described in the Hirano et al. patent, a RF signal is transmitted by a portable transmitter circuit and received by an antenna associated with a vehicle mounted controller, where the controller is either a receiver as noted above or a transceiver. In either case, the vehicle controller includes receiving circuitry connected to the antenna for receiving the RF signal which contains the digital signal having a security code. Proposals have been made that require very low allowable transmitter power requirements.

In the Hirano et al. keyless entry system discussed above, the antenna for the receiver controller is located remote from the controller itself and is placed, for example, in a side mounted rearview mirror mounted on the front passenger door as opposed to being mounted on the controller itself. Automobile manufacturers prefer, however, to employ an antenna that is internal to the RKE receiver itself.

An antenna which is of relative small size and is mounted adjacent to a radio frequency (RF) controller is known in the art and takes the form shown in the patent drawings herein at FIG. 5. That antenna is provided by Nippondenso Co. Ltd.

of Japan and includes two horizontal helices 202 and 204 each having one end connected in common and mounted on a ground plane 206. The two helices are oriented at right angles to one another and bent so that they are horizontal or parallel to the ground plane located on a circuit board associated with the RF controller. One helical axis is pointed in a forward direction of the vehicle and the other helical axis is pointed in transverse direction. The radiation patterns associated with these two helices are each approximately 20° to 60° wide centered about the associated helical axis and thus are not omni-directional. An operator approaching such a vehicle obliquely from the rear may not be detected by such an antenna when the operator actuates a portable transmitter to transmit a RF signal toward the vehicle.

SUMMARY OF THE INVENTION

In accordance with the present invention, a vehicle controller is provided for use in a remote keyless entry system for controlling a vehicle device function such as the locking-unlocking functions of a vehicle door lock. The vehicle controller includes a receiving circuit for receiving a RF request signal including a security code that uniquely identifies a portable transmitter that is authorized entry into the vehicle. The controller controls access to the vehicle when the received security code matches a prestored security code. The controller includes a circuit board that carries the receiving circuit and also carries a flat ground plane. A helical antenna is mounted on the circuit board and includes an elongated conductive member having a free end and an opposite end. The opposite end is electrically connected to the receiving circuit. The conductive member is helically coiled about an axis intermediate the ends of the conductive member with the axis being perpendicular to the ground plane. The helical antenna is configured so as to provide an omni-directional radiation pattern centered about the axis.

BRIEF DESCRIPTION OF THE DRAWINGS

The foregoing and other objects of the invention will become more readily apparent from the following description of the preferred embodiment of the invention as taken in conjunction with the accompanying drawings which are a part hereof and wherein:

FIG. 1 is a schematic-block diagram of a portable transceiver in accordance with the present invention;

FIG. 3 is an illustration of an interrogation signal transmitted by the vehicle transceiver;

FIG. 4 is an illustration of a coded reply signal transmitted by a portable transceiver;

FIG. 5 is a plan view of a prior art multiple helix antenna;

DESCRIPTION OF PREFERRED EMBODIMENTS

Figure 2:
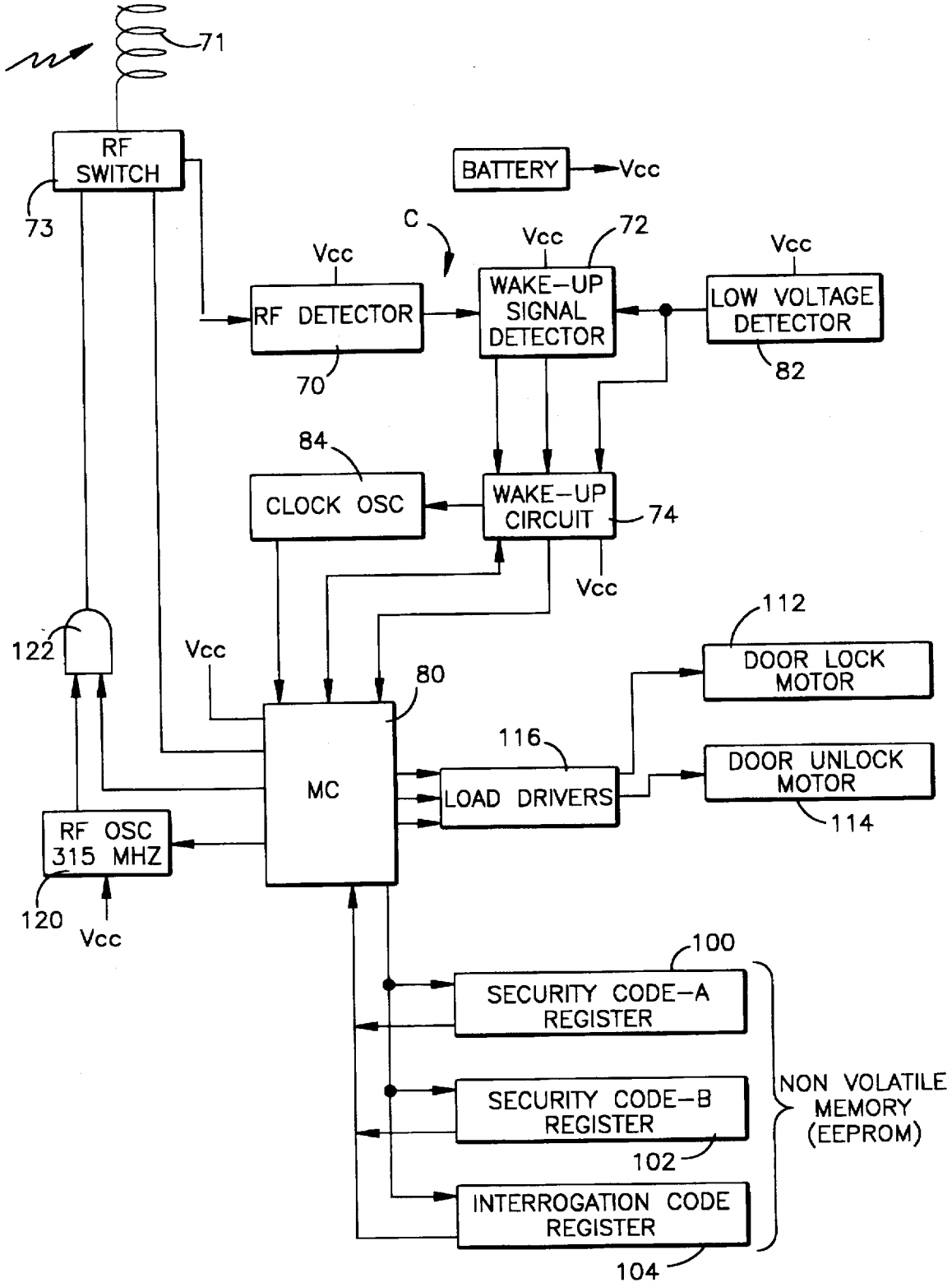
FIG. 2 is a schematic-block diagram of a vehicle transceiver in accordance with the present invention.

Reference is now made to the drawings wherein the showings are for purposes of illustrating a preferred embodiment of the invention only, and not for the purpose of limiting same. The keyless entry system described herein may include one or more remote, portable interactive transceivers or "badges" which communicate with a vehicle transceiver to achieve remote control of the vehicle's door lock and unlock mechanisms. The portable transceivers are identified herein as transceivers A and B. Only the circuitry of transceiver A will be described herein in detail.

Each of the remote transceivers A and B is assigned a security code unique to the particular transceiver. The vehicle transceiver C is mounted on a vehicle and will permit entry into the vehicle of an operator carrying a transceiver which is coded with a proper security code. In the example being given, transceivers A and B are provided with proper security codes SCA and SCB, respectively, which will permit entry into the vehicle in which is mounted transceiver C.

Each portable transceiver takes the form of transceiver A as illustrated in FIG. 1 and described in greater detail in U.S. patent application Ser. No. 08/404,165, filed on Mar. 14, 1995 the disclosure of which is incorporated by reference herein. Transceiver A includes a microcomputer 10 and is powered by a miniature battery 12. The microcomputer also includes a number of internal registers which are used during program execution for storage and manipulation of data and instructions. Several of the registers are illustrated in FIG. 1 external to the microprocessor to assist in the explanation of the system. The illustrated registers include a security code register 50, and an interrogation code register 52. The security code register 50 contains a code which uniquely identifies transceiver A. The interrogation code register 52 contains a vehicle code that uniquely distinguishes the vehicle transceiver C from similar transceivers in other vehicles.

The vehicle transceiver C (FIG. 2) periodically transmits a radio frequency (RF) interrogation signal. The RF interrogation signal is a RF carrier signal which is keyed by a baseband digital interrogation signal having a pattern as shown in FIG. 3. As shown in FIG. 3, the interrogation signal includes a wake-up portion 14, an interrogation portion 16 and a listen portion 18. The wake-up portion 14 serves to wake up the receiving portable transceiver, such as transceiver A. The interrogation portion 16 includes vehicle identification information, sometimes referred to as a vehicle code.

The portable transceiver A includes a RF detector 30 which is tuned to the carrier frequency of the RF interrogation signal transmitted by the vehicle transceiver C. As the interrogation signal is received at the portable transceiver's receiving antenna 32, the detector 30 demodulates the signal to recover the baseband digital interrogation signal, and passes the recovered signal to a wake-up signal detector 34. The wake-up signal detector 34 activates a wake-up circuit 36 for supplying power P to the transceiver's microcomputer 10 as well as to oscillators 38 and 40.

The data in the recovered interrogation signal (FIG. 3) is clocked into the microcomputer 10. The microprocessor compares the interrogation or identification code with the code stored in the interrogation code register 52. If a match occurs then, under program control, the transceiver A transmits a badge reply signal (see FIG. 4).

The carrier oscillator 38 has a nominal frequency of 315 MHz and is employed for transmitting the reply signal from the portable transceiver A back to the vehicle transceiver C. Other carrier frequencies can be used as required, i.e., 433.92 MHz for Europe. The reply signal (see FIG. 4) includes coded information in the form of binary 1 and binary 0 signals which are superimposed on the 315 MHz carrier signal. The reply signal transmitted by the transceiver A has a range on the order of two to four meters.

The badge reply signal includes a wake-up portion 60, a start portion 61, a security code portion 62, and a function code portion 64. The security code is taken from security code register 50. The function code will normally be an "open door" code, which requests unlocking of the doors.

The vehicle transceiver C (FIG. 2) is described in greater detail in the aforesaid U.S. patent application Ser. No. 08/404,165 and includes a RF detector 70. The detector 70 allows the first portion 60 of the reply signal (FIG. 4) to pass to a wake-up signal detector 72. Detector 72 activates the wake-up circuit 74 which, in turn, powers-up the circuit by supplying operating voltage $V_{cc}$ to the transceiver's microcomputer 80. The operating voltage is monitored by a low voltage detector 82 to permit operation of the circuitry so long as the voltage does not drop below a selected level.

Some of the internal memory locations of the microcomputer 80 are illustrated in FIG. 2 to assist in the description of the invention. These include registers 100, 102 and 104. Register 100 stores a security code identifying a portable transceiver (e.g., transceiver A) authorized to gain access to the vehicle.

Register 102 stores a different security code identifying a second, different, authorized portable transceiver (e.g., transceiver B). Register 104 contains vehicle identification data which uniquely identifies the vehicle transceiver C.

If transceiver C receives a valid digital signal from transceiver A, then the microcomputer 80 will decode the function code portion of the received signal and perform the requested function, usually a door lock function for locking or unlocking a vehicle door by way of suitable motors 112 and 114 driven by load drivers 116.

As previously mentioned, the vehicle transceiver C periodically transmits an interrogation signal as illustrated in FIG. 3. That signal includes data in the form of a series of binary signals, superimposed on a carrier signal provided by oscillator 120. The carrier signal is modulated by gating it through an AND gate 122 under control of the microcomputer.

Portable transceiver A receives the interrogation signal and, if the interrogation code received from transceiver C matches the code prestored in the register 52 in transceiver A, transmits a reply signal back to transceiver C. Upon receipt of the reply signal, transceiver C compares the reply security code with the codes stored in registers 100 and 102 to determine if a match exists. If a match exists, the microcomputer 80 causes the doors of the vehicle to unlock.

In the embodiment being described herein, it is contemplated that the antenna 71 of the vehicle transceiver C (FIG. 2) will be used both to transmit and receive signals. To accomplish this, a RF switch 73 is provided to selectively connect either the output of gate 122 or the input of detector 70 to the antenna. The switch is preferably electronic (but may be electromechanical) and is controlled by the microcomputer 80. During periods that the transceiver is operating as a transmitter, the switch will be set to pass the output from gate 122 to transmit a demand signal by way of antenna 71. In a receiving mode, the microcomputer 10 will set the RF switch 73 so that a RF signal received from a portable transceiver, such as transceiver A of FIG. 1, is directed to the RF detector 70. For maximum power transfer, the impedance of antenna 71 is matched to that of detector 70 and AND gate 122 in combination with oscillator 120. The impedance of the RF switch is negligible.

In accordance with the present invention, the antenna 71 is a helical antenna. This helical antenna is a small high performance antenna having a vertical helical form. The helical antenna is a conductor which spirals along a cylindrical surface, where the cylindrical surface has its axis oriented in the Z direction in a standard XYZ coordinate system where the XY plane is a horizontal ground plane. The antenna is configured so as to operate with an omni-directional pattern (in the horizontal plane) so that an operator approaching the vehicle from any direction may be detected when the operator actuates a portable transmitter to transmit a RF signal toward the vehicle.

Figure 6:
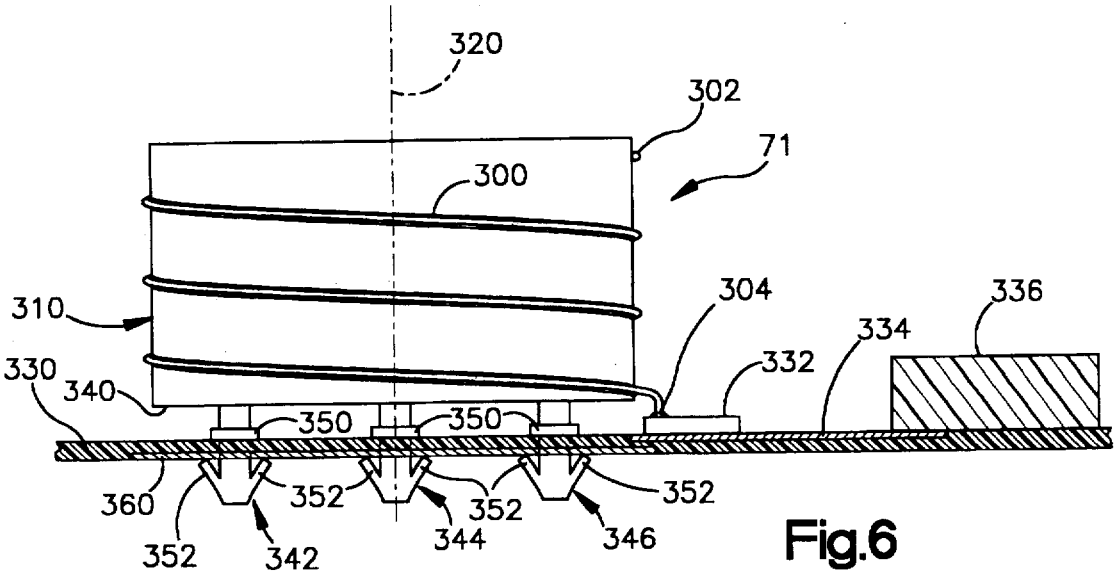
FIG. 6 is an elevation view, partly in section, of one embodiment of the invention.

The helical antenna 71 is illustrated in FIG. 6 and includes an elongated conductor 300, which may be constructed of copper, having an upper free end 302 and a lower end 304. The conductor 300 is helically wrapped about a cylindrical bobbin 310. This bobbin may be constructed of a non-conductive material such as plastic or the like.

Figure 7:
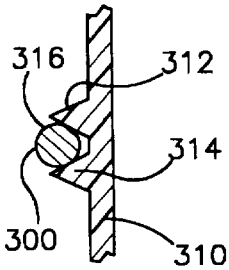
FIG. 7 is an enlarged fragmentary sectional view illustrating the relationship of a conductor and a bobbin in FIG. 6.

FIG. 7 is an enlarged fragmentary sectional view illustrating the relationship of the conductor 300 to the bobbin 310. The bobbin 310 has on its outer surface a helical track defined by a pair of axially spaced helical ribs 312 and 314 having a common axis of curvature. The recess or track 316 between the ribs 312 and 314 serves to receive the conductor 300. The conductor 300 may be held in the track either with a press fit or with a suitable adhesive.

The conductor 300 carried by the bobbin 310 is helically wound about a helix axis 320. The bobbin 310 is supported on a printed circuit board 330 which also carries the circuitry making up the vehicle controller shown in FIG. 2 (but not the door lock motors 112 and 114). The printed circuit board 330 is provided with a metal pad 332 to which the bottom end 304 of conductor 300 is soldered to provide a good electrical connection. This metal pad 332 is connected by a suitable metal trace 334 to the circuitry as indicated schematically by the block 336.

The bobbin 310 may be physically mounted to the printed circuit board 330 so that the lower surface 340 of the bobbin is vertically spaced from the upper surface of the printed circuit board. In this embodiment, as shown in FIG. 6, the mounting is achieved with the use of three mounting legs 342, 344, and 346 which extend axially from the bottom of the bobbin 310 and are spaced apart from each other by 120° about the axis 320. Each leg includes an annular flange 350 spaced downwardly from the lower surface 340 of the bobbin and which rests on the upper surface of the printed circuit board 330. The printed circuit board 330 is provided with apertures for receiving legs 342, 344, and 346. The lower end of each leg is wedge-shaped and has spring-like fastening barbs 352 that, in assembly, resiliently bear against the lower surface of the printed circuit board 330 to hold the bobbin in place.

The lower surface of the printed circuit board 330 also carries a ground plane 360 is located immediately underneath the antenna 71. The ground plane 360 is a flat, circular disk which coaxially surrounds axis 320 and has a diameter somewhat greater than that of the bobbin 310 and preferably at least as great as the diameter of the helix antenna. Ground plane 360 is constructed of conductive material, such as copper, and is electrically connected to the vehicle grounding system.

Figure 8:
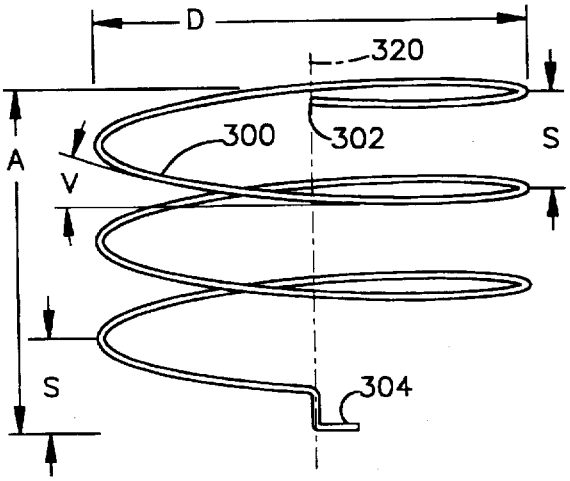
FIG. 8 is an elevation view of one embodiment of a helix in accordance with the invention.
Figure 9:
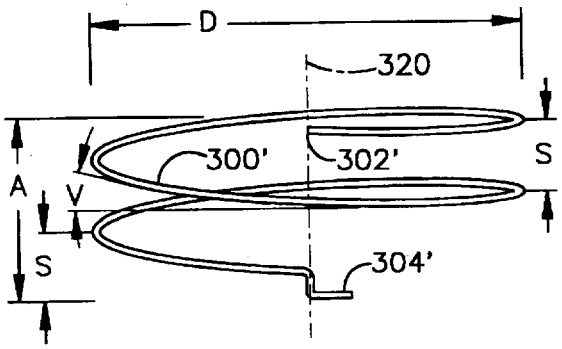
FIG. 9 is an elevation view of a second embodiment of a helix in accordance with the invention.

Reference is now made to FIGS. 8 and 9 which illustrate the geometry of the helical antenna in greater detail. A helical antenna of the general type shown may have two radiation modes of operation, an "axial mode" and a "normal mode." When operating in the "normal mode", the antenna has an omni-directional pattern. When operating in the "axial mode", the pattern is highly directional, with the pattern centered about the helical axis. A helical antenna will operate in the "axial mode" if the helix diameter D is on the order of one wavelength. The "normal mode" of operation will arise, however, when the diameter of the helix is much less than one wavelength. The total length of the helical conductor should be on the order of one-third wavelength or 0.35λ in order to tune the antenna to the desired frequency of operation in the "normal mode".

In FIG. 8 the antenna conductor 300 is shown as having three turns and is configured for normal operation at a RF frequency of 315 MHz. The elongated conductor 300 has a helix diameter D on the order of 3.25 cm. The spacing S between helical turns as measured from center-to-center is on the order of 0.55 cm. The total wire length of the conductor 300 is on the order of 3.25λ (approximately 28 cm). The pitch angle V between adjacent turns is on the order of 3.1°.

The conductor 300' of FIG. 9 has approximately two turns and is configured for normal operation at 433.92 MHz. The conductor 300' is of a shorter length (on the order of 19 cm) than conductor 300, to preserve the 0.35λ relationship. The spacing S between turns is on the order of 0.75 cm and the helix diameter D is on the order of 3.25 cm. The pitch angle V is on the order of 4.2°.

The antennas shown in FIGS. 8 and 9 are tuned to resonate at their desired frequencies by trimming the coil wire at the open end 302 or 302'. During testing, such an antenna will resonate and emit an omni-directional pattern when a RF signal, at the desired frequency, is inserted at the end 304 of the antenna, and the antenna is mounted above a solid ground plane, such as ground plane 360.

It has been determined that the vertical helix antenna illustrated herein at FIGS. 6, 8, and 9 outperforms horizontal multiple helices antennae, as shown in FIG. 5, by approximately 4 to 6 dB. Moreover, the vertical helix antenna is circularly polarized which allows it to provide uniform range around a vehicle and be insensitive to the relative orientation of the antenna in the portable transceiver. The vertical helix antenna provides a flat frequency response around the desired frequency, 315 MHz or 433.92 MHz. Such a flat frequency response is beneficial when there is some tolerance associated with the frequency of the incoming signal.

From the above description of the invention, those skilled in the art will perceive improvements, changes, and modifications. Such improvements, changes, and modifications within the skill of the art are intended to be covered by the appended claims.

Having described the invention, we claim the following:

1. A vehicle controller for use inside a vehicle in a remote keyless entry system for controlling a vehicle device function comprising means for receiving a coded RF request signal from a portable transmitter and means for controlling said vehicle device upon receipt of a proper said RF request signal, wherein said receiving means includes a flat non-conductive circuit board, a flat ground plane disposed on said circuit board, and a helical antenna mounted on said circuit board and electrically insulated from said ground plane by said circuit board and including an elongated conductive member having a signal output end and an opposite free end, said conductive member being helically coiled about a helical axis with said helical axis being oriented perpendicular to said ground plane with said antenna being configured to provide an omni-directional radiation pattern about said helical axis.

2. A vehicle controller as set forth in claim 1 wherein said helical antenna has a plurality of helical turns and wherein each turn has a helical diameter which is substantially less than the wavelength at the operating frequency of said RF signal.

3. A controller as set forth in claim 1 wherein the length of said conductive member is less than that of said wavelength.

4. A controller as set forth in claim 3 wherein the length of said conductive member is on the order of one-third that of said wavelength.

5. A controller as set forth in claim 4 wherein the diameter of each said helix is substantially less than that of the length of said conductive member.

6. A controller as set forth in claim 5 wherein the diameter of each said helix is less than one-fourth than that of the length of said conductive member.

7. A controller as set forth in claim 6 wherein said free end of said conductive member is spaced from said circuit board by a distance on the order of approximately one-half that of said helix diameter.

8. A controller as set forth in claim 1 including means for mechanically supporting said helical antenna on said circuit board.

9. A controller as set forth in claim 8 wherein said means for mechanically supporting includes a cylindrical bobbin mounted to said printed circuit board with said bobbin coaxially surrounding said helical axis.

10. A controller as set forth in claim 9 wherein said bobbin is constructed of electrical insulating material.

11. A controller as set forth in claim 10 wherein said bobbin includes conductor mounting means for carrying said conductor intermediate its ends.

12. A controller as set forth in claim 11 wherein said conductor mounting means includes a pair of axially spaced apart helical ribs having a common axis of curvature located in a side wall of said bobbin and having a recess defined between said helical ribs for receiving said conductive member.

* * * * *